United States Patent [19]

Llewellyn

[11] 4,175,744

[45] Nov. 27, 1979

[54] EYE-HAND COORDINATOR

[75] Inventor: Link W. Llewellyn, Flint, Mich.

[73] Assignee: Chi Rho Corporation, Flint, Mich.

[21] Appl. No.: 891,553

[22] Filed: Mar. 30, 1978

[51] Int. Cl.[2] ..... A63B 69/40

[52] U.S. Cl. ..... 273/26 E; 273/200 B

[58] Field of Search ..... 273/26 E, 29 A, 184 R, 273/184 B, 185 D, 196, 197 R, 200 B, 208, 95 A, 58 C

[56] References Cited

U.S. PATENT DOCUMENTS

| | | | |
|---|---|---|---|
| 649,190 | 5/1900 | Zimmerman | 273/200 B |
| 2,818,255 | 12/1957 | Ponza | 273/26 E |
| 3,333,847 | 8/1967 | Pennington | 273/26 E |
| 3,341,200 | 9/1967 | Brandley | 273/26 E |
| 3,408,070 | 10/1968 | Gonzoles et al. | 273/26 E |
| 3,794,320 | 2/1974 | Salmont | 273/29 A |
| 3,908,990 | 9/1975 | Spurgeon | 273/26 E |
| 4,105,203 | 8/1978 | Cho | 273/29 A |

*Primary Examiner*—Richard C. Pinkham
*Assistant Examiner*—T. Brown
*Attorney, Agent, or Firm*—McGlynn and Milton

[57] ABSTRACT

An eye-hand coordinator assembly including a cam mechanism operatively connecting one end of a ball-supporting arm to a standard for allowing the arm and a ball to be displaceable from an initial position in response to an impact to the ball. The cam mechanism includes an upper cam and a lower cam with the upper cam being movable for rotation and axial shifting from a rest position relative to the lower cam. The cam mechanism is adjustably retained on the standard by an adjustment pin which extends through an opening in the lower cam and one of a plurality of vertically spaced adjustment holes in the standard. An elastic strap is disposed about the adjustment pin and a projecting stub shaft on the upper cam to interconnect the upper cam and the lower cam for resisting the rotary movement and axial shifting of the upper cam relative to the lower cam and for urging the upper cam to its rest position thereby returning the arm to its initial position after an impact to the ball. A first flange on the upper cam and a second flange on the lower cam are engageable after a predetermined amount of rotational movement of the upper cam relative to the lower cam to provide a stop. The standard is connected to a mounting surface which is supported by mounting beams. A platform for a player to stand on is supported by platform beams which have a telescoping relationship with the mounting beams so that the distance from the platform to the ball is adjustable. Additionally, the assembly includes a ground level arm for positioning the ball at ground level which is attached to a nose portion on the upper cam by a tubular member having an axial opening for mounting onto the nose portion.

11 Claims, 6 Drawing Figures

EYE-HAND COORDINATOR

BACKGROUND OF THE INVENTION (1) Field of the Invention

The subject invention relates to an eye-hand coordinator or batting practice device wherein a returnable arm supports a ball which may be struck. These devices are used to provide exercise, improving swings for sports where an object or ball is to be struck, increasing strength, developing eyehand coordination, therapy in Special Education classes, etc. These devices are used indoors and outdoors by children and adults, therefore, it is desirable that these devices are adjustable, durable, and portable, yet stable.

(2) Description of the Prior Art

Typically, the prior art eye-hand coordinators or batting practice devices employ a ball mounted on a returnable arm; however, the prior art devices are complex in structure and are not economically and easily manufactured and are not suitable for ground level sports such as golf, hockey, etc.

SUMMARY OF THE INVENTION

The subject invention relates to an eye-hand coordinator assembly having cam means operatively connecting one end of a ball-supporting arm to a standard for allowing the arm and a ball connected at the other end thereof by a first connecting means to be displaceable from an initial position to various angular positions relative to the axis of the standard in response to an impact to the ball. A second connecting means connects the one end of the arm to the cam means. The cam means includes an upper cam and a lower cam with the upper cam being movable for rotation and axial shifting from a rest position relative to the lower cam. Biasing means positioned on the outside of the standard interconnect the upper cam and the lower cam for resisting the aforementioned rotary movement and axial shifting of the upper cam relative to the lower cam and urge the upper cam to the rest position thereby returning the arm to its initial position after an impact to the ball. Additionally, the subject invention includes a ground level attachment means for attaching a ground level arm to the cam means whereby the ground level arm is operatively connected to the standard.

PRIOR ART STATEMENT

Typical of a batting practice device or eye-hand coordinator assembly of the type to which the instant invention pertains is that shown in U.S. Pat. No. 2,818,255, granted Dec. 31, 1957 to L. J. Ponza. That patent discloses a connecting rod which limits rotation and axial shifting of an upper cam coacting with a roller pin by connection to a spring which has a fixed position inside of a standard. The subject invention is an improvement thereover by employing resilient means on the outside of the standard which interconnects an upper cam and a lower cam to provide easy vertical adjustment and a simpler return mechanism.

U.S. Pat. No. 3,341,200, granted Sept. 12, 1967 to E. W. Brandley discloses a ball-supporting arm which is connected to a coupling which is adjustably mounted on a standard. The coupling, however, is freely rotatable and does not provide a quick return as does the instant invention.

U.S. Pat. No. 3,333,847, granted Aug. 1, 1967 to D. D. Pennington discloses a batting practice device which includes an electric motor and a clutch for adjusting the speed of a ball-supporting arm. This patent, however, is complex in structure and does not employ a cam mechanism.

Additionally, none of the prior art patens discussed above suggest a ground level arm and attachment means therefor to postion a ball at ground level for allowing a player to practice ground level sports such as golf, hockey, etc.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
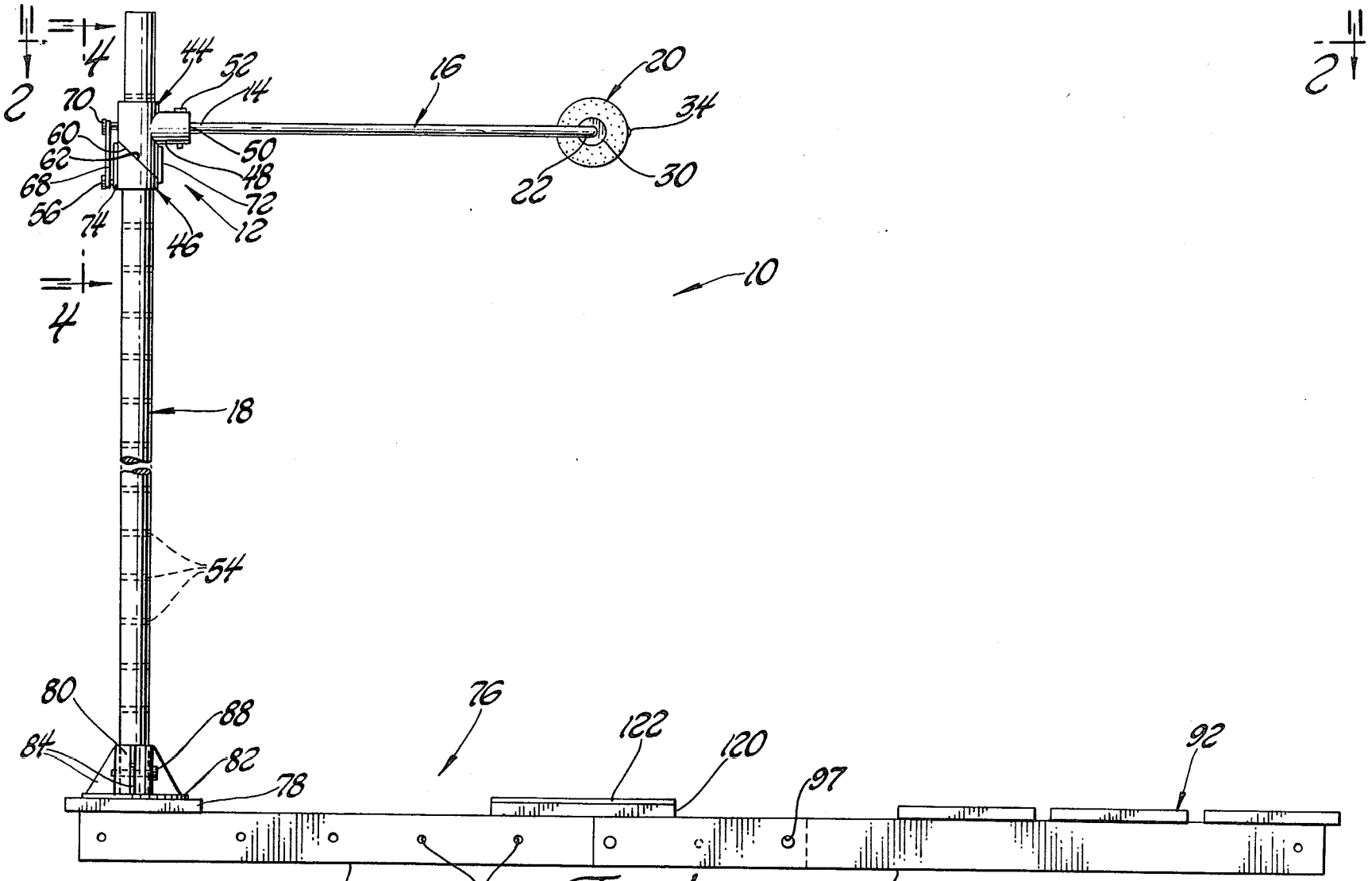
FIG. 1 is an elevational side view of an eye-hand coordinator assembly constructed in accordance with the instant invention.

Referring to FIG. 1, an eye-hand coordinator assembly constructed in accordance with the subject invention is generally shown at 10. A cam means generally shown at 12 operatively connects one end 14 of a ball-supporting arm generally indicated at 16 to a standard generally indicated at 18 for allowing the arm 16 and a ball generally indicated at 20 at the other end or distal end 22 of the arm 16 to be displaceable from an initial position to various angular positions relative to the axis of the standard 18 in response to an impact to the ball 20.

Figure 5:
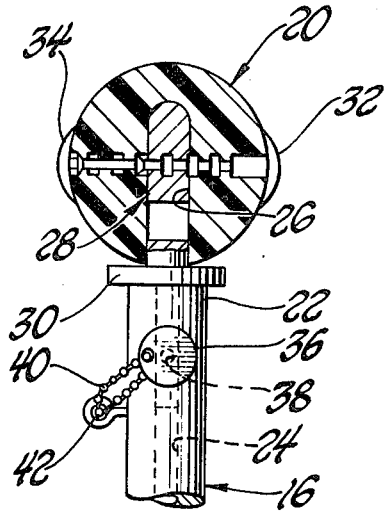
FIG. 5 is an enlarged fragmentary cross-sectional view of a portion of the embodiment shown in FIG. 1.

Referring to FIG. 5, the ball 20 is connected to the distal end 22 of the arm 16 by a first connecting means. The first connecting means includes a recess 24 in the distal end 22 of the arm 16 which is interconnected to another recess 26 in the ball 20 by a first connecting pin generally indicated at 28. Thus, the first connecting pin 28 extends into the recesses 24 and 26 to connect the ball 20 to the arm 16. The first connecting pin 28 has a support flange 30 for supporting the ball 20 when there is an impact thereto. The first connecting means also includes pins 32 and 34 which extend through the ball 20 and the first connecting pin 28. As shown in FIG. 5, pin 32 has slots which receive spikes or projections on pin 34 when pin 34 is inserted into pin 32 which provides a push and lock type connection. It is also possible, however, to provide a threaded engagement or the like to connect pins 32 and 34. Still further, a retention pin 36 extends through holes 38 in the distal end 22 of the arm 16 and the first connecting pin 28 in order to retain the first connecting pin 28 in the recess 24 in said distal end 22 of the arm 16. A cotter pin or the like may be used to retain the retention pin 36 in position. It is noted that the retention pin 36 may be attached to the arm 16 by a ball chain 40 connected to an eye loop 42 secured to the arm 16 in order to prevent loss of the retention pin 36. It will also be understood that various connecting, adjustment and mounting pins described hereinafter may also be similarly connected to various parts of the assembly 10 to prevent loss of the pins.

The first connecting means, as described above, allows various balls to be easily interchanged in the event that a ball becomes worn or a different size ball is desired. Thus, when the assembly 10 is used as therapy in Special Education classes, hospitals, or at home, progressive therapy is possible while improving coordination in that the balls may be interchanged from a large ball, such as a soft ball, for gross motor coordination, to small balls, such as a golf ball, for finer motor coordination. It is also possible to employ a beeper or similar means to allow use of the assembly 10 by blind people. In short, the use of the term "ball" includes any member, including a hockey puck or the like, to be employed in a manner to be later described.

Referring to the drawings in general, the one end or proximal end 14 of the arm 16 is connected to the cam means 12 by a second connecting means. As will later be described in greater detail, the cam means 12 includes an upper cam generally indicated at 44 and a lower cam generally indicated at 46. The second connecting means includes a nose portion 48 on the upper cam 44. The nose portion 48 has an annular cavity 50 therein for receiving the proximal end 14 of the arm 16. A second connecting pin 52 is inserted through holes in the nose portion 48 and the proximal end 14 of the arm 16. A cotter pin or the like may also be used to retain the second connecting pin 52 in position.

Figure 2:
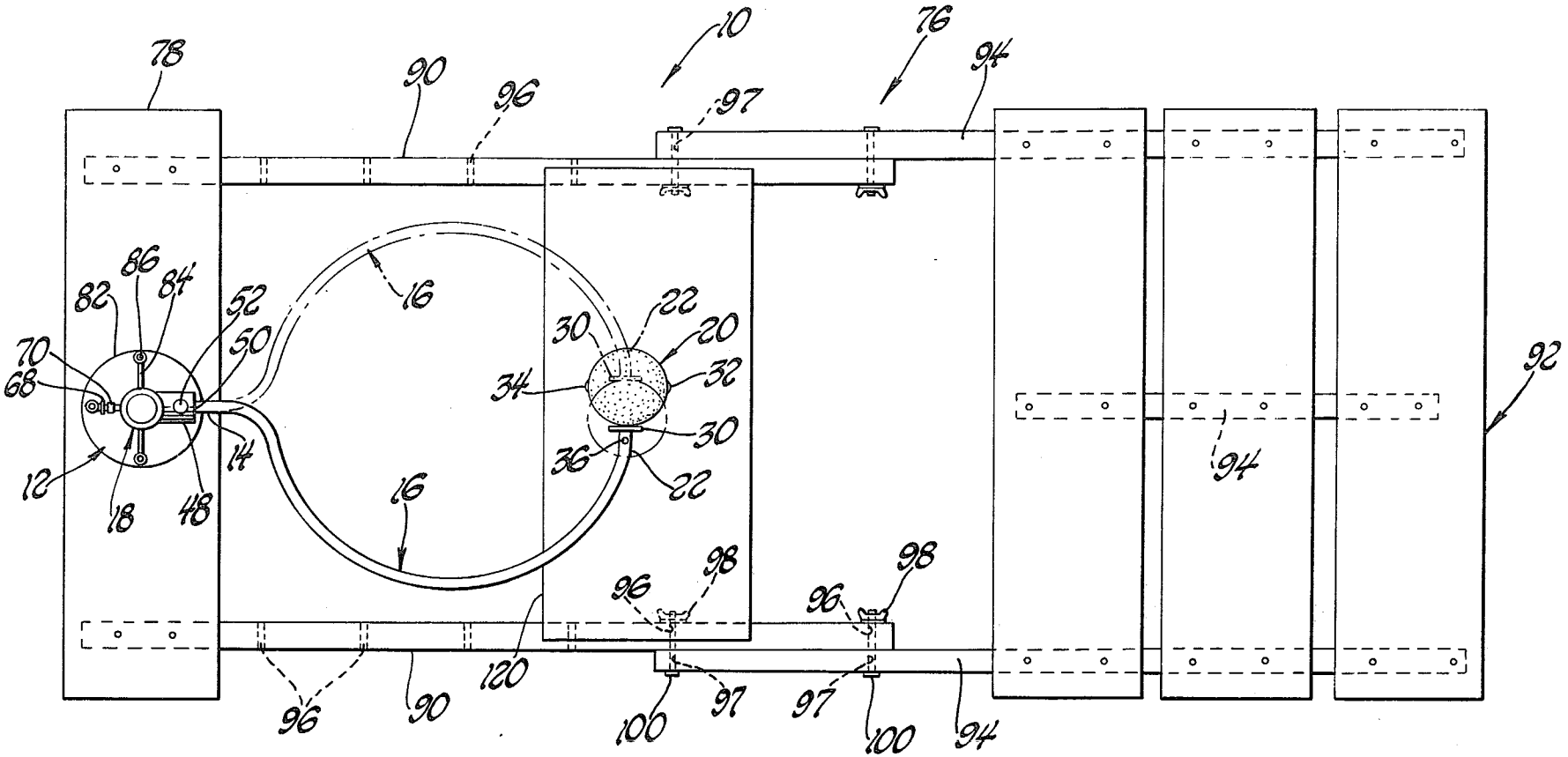
FIG. 2 is a top view taken substantially along line 2—2 of FIG. 1.

Referring to FIG. 2, the arm 16 has a curved configuration. The position of the arm 16 may be easily reversed or flipped 180° for use by right-handed players as shown by the solid lines or for use by left-handed players as shown in phantom by merely removing the second connecting pin 52 and positioning the arm 16 for use by a right-handed or left-handed player, as well as forehand and backhand use.

Figure 3:
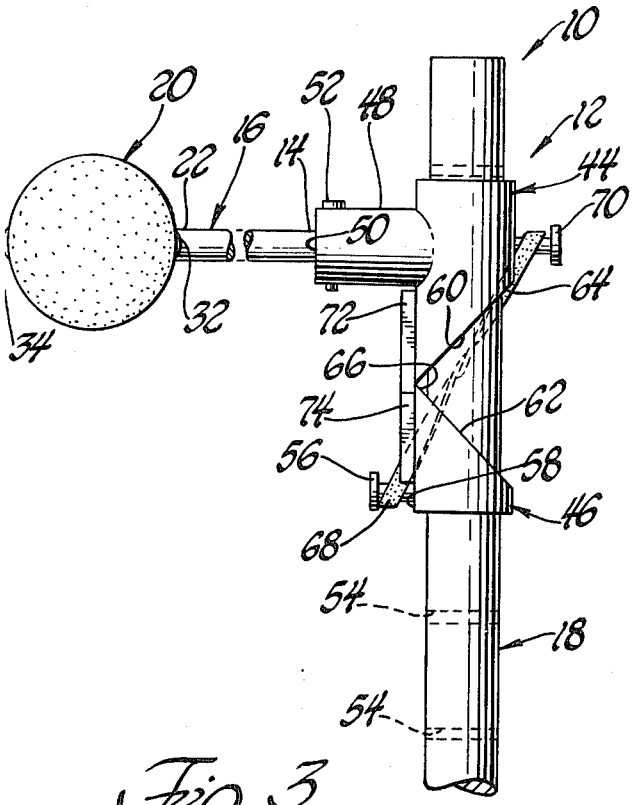
FIG. 3 is an enlarged fragmentary view of a portion of the embodiment shown in FIG. 1 and shown in an alternative position.
Figure 4:
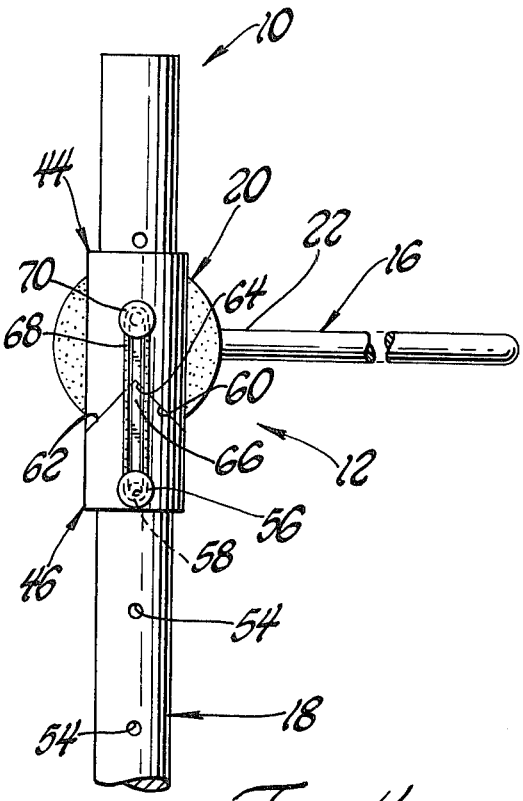
FIG. 4 is an enlarged fragmentary view taken substantially along line 4—4 of FIG. 1.

Referring to FIGS. 1, 3 and 4, the cam means 12 may be retained on the standard 18 at various different vertical positions by an adjustment means. The adjustment means includes a plurality of vertically spaced adjustment holes 54 in the standard 18. An adjustment pin 56 extends through an opening 58 in the lower cam 46 and through one of the adjustment holes 54 of the standard 18 to provide various different vertical positions of the cam means 12. The adjustment means also allows the cam means 12 to be retained in one of two diametrically opposite 180° out-of-phase positions with respect to the standard 18.

Still referring to FIGS. 1, 3 and 4, the upper cam 44 is movable for rotation and axial shifting from a rest position relative to the lower cam 46. Biasing means, positioned on the outside of the standard 18, interconnect the upper cam 44 and the lower cam 46 for resisting this rotary movement and axial shifting of the upper cam 44 relative to the lower cam 46 and urge the upper cam 44 to its rest position thereby returning the arm 16 to the arm's initial position after an impact to the ball 20. The upper cam 44 includes an upper cam surface 60 and the lower cam 46 includes a lower cam surface 62. The upper cam surface 60 and the lower cam surface 62 coact with each other to provide the rest position of the upper cam 44 and the rotary and axial shifting movement from the rest position. The upper cam surface 60 includes two sloping portions with these portions sloping downwardly from a crevice 64. The lower cam surface 62 includes two sloping portions with these portions sloping downwardly from a crest or peak 66. The crest 66 is engageable with the crevice 64 to provide the rest position of the upper cam 44. The surfaces 60 and 62 are complimentary to one another as they engage in the rest position. Upon an impact to the ball 20, the upper cam surface 60 rotates and rides up the lower cam surface 62 to provide the various angular positions of the arm 16 relative to the axis of the standard 18.

The biasing means which interconnect the upper cam 44 and lower cam 46 to resist the rotary movement and axial shifting of the upper cam 44 relative to the lower cam 46 includes an elastic strap 68 which is disposed about a projecting stub shaft 70 on the upper cam 44 and the adjustment pin 56. In operation, the natural or original position of the assembly 10 is shown in FIG. 4 wherein the cam means 12 is in its rest position and the arm 16 is in its initial position. Upon an impact to the ball 20, the upper cam surface 60 and lower cam surface 62 coact to allow the upper cam 44 to rotate and ride up on the lower cam 46 to various positions, one of which is shown in FIG. 3 which allows the arm 16 to be displaced from its initial position. The biasing means or elastic strap 68 resists the rotary movement and axial shifting of the upper cam 44 and urges the upper cam 44 back to its rest position shown in FIG. 4 thereby returning the arm 16 to its initial position. Since the elastic strap 68 is positioned on the outside of the standard 18, the resistance of movement of the arm 16 and cam means 12 may be easily increased or decreased by changing the number, size or configuration of the elastic strap 68 and the elastic strap 68 may be easily replaced or repaired. In other words, variable resistance to movement of arm 16 may be provided by changing the size or configuration of elastic strap 68 or by adding additional straps.

The above-described rotary and axial shifting movement is limited by stop means which are included in the cam means 12. Referring to FIGS. 1 and 3, the stop means includes a first flange 72 on the upper cam 44 and a second flange 74 on the lower cam 46. The first flange 72 and the second flange 74 are engageable after a predetermined amount of rotational movement of the upper cam 44 relative to the lower cam 46. Thus, the rotation of the upper cam 44 will be stopped or limited to less than 360° or a complete revolution. This feature provides an extremely rapid return of the arm 16 after an impact to the ball 20 and any oscillation is rapidly eliminated when the crevice 64 and crest 66 engage with each other. As a result, the assembly 10 requires less room than would be required if the arm 16 were allowed to rotate 360° which makes the instant invention particularly adaptable for inside use.

Referring to FIGS. 1 and 2, the assembly 10 also includes a base means generally shown at 76 for supporting the standard 18. The base means 76 includes a mounting surface 78 and a mounting means for connecting the standard 18 to the mounting surface 78. The mounting means includes a sleeve member 80 for receiving the standard 18. A base ring 82 is interconnected to the sleeve 80 by a plurality of spokes 84. A plurality of holes in the base ring 82 receive bolts 86 for fastening the base ring 82 to the mounting surface 78. A mounting pin 88 is insertable through holes in the sleeve 80 and the standard 18 to releasably connect or mount the standard 18 in the sleeve 80 and also to allow the standard 18 to be supported such that the standard 18 has at least two diametrically 180° out-of-phase positions. The sleeve member 80 and standard 18 may be keyed in order to facilitate a secure attachment and to prevent rotation of standard 18 relative to sleeve 80.

Still referring to FIGS. 1 and 2, the mounting surface 78 is supported by at least two mounting beams 90 which are positioned in parallel relationship. A platform 92 for a player to stand on is supported by platform beams 94. As best seen in FIG. 2, the platform beams 94 have a telescoping relationship with the mounting beams 90. A positioning means is provided for connecting the mounting beams 90 and the platform beams 94 at various horizontal positions relative to each other so that the distance from the platform 94 to the ball 20 is adjustable.

The positioning means includes a plurality of positioning holes 96 and 97 disposed longitudinally along the mounting beams 90 and the platform beams 94, respectively. Wing nuts 98 threadedly engage bolts 100 which extend through certain of the positioning holes 96 in the mounting beams 90 and corresponding positioning holes 97 in the platform beams 94. Thus, the adjustable positioning of the base means 76 and adjustable vertical positions of the cam means 12 readily allows the instant invention to be used by children and adults.

Figure 6:
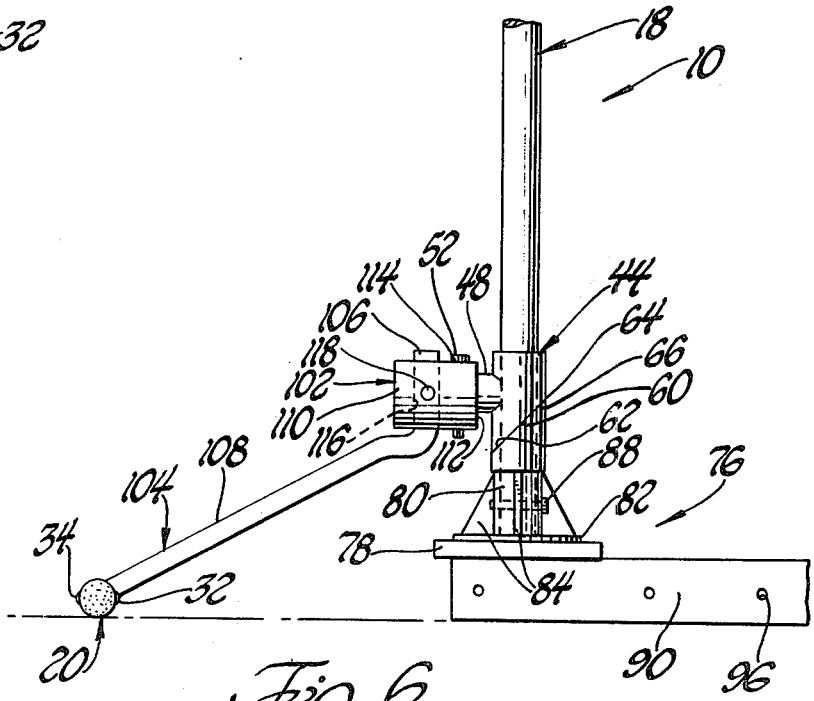
FIG. 6 is an elevational side view of another embodiment of the instant invention.

Referring to FIG. 6, another novel feature of the instant invention is a ground level attachment means generally indicated at 102 for attaching a ground level arm generally indicated at 104 to the cam means 12 whereby the arm 104 is operatively connected to the standard 18. The ground level arm 104 positions the ball 20 at ground level which allows a player to practice sports wherein a ball is typically at ground level as in hockey, golf, etc. It is understood that the term "ground level" may include the ball 20 actually contacting a surface or ground, as well as a position wherein the ball is slightly spaced from the ground as in a golf ball on a golf tee.

The ground level arm 104 includes a projecting attachment portion or leg 106 and an extension or ball-supporting portion 108 sloping downwardly from the leg or projecting attachment portion 106 to the distal end of the extension portion 108. As described above, a first connecting means connects the ball 20 to the distal end of the ground level arm 104.

The ground level attachment means 102 includes a tubular member 110 having an axial opening 112 for mounting onto the nose portion 48 of the upper cam 44. The ground level attachment means further includes a third connecting means for connecting the tubular member 110 to the nose portion 48 of the upper cam 44 and a fourth connecting means for connecting the ground level arm 104 to the ground level attachment means 102.

The third connecting means includes a hole 114 in the tubular member 110 which may be aligned with the above-mentioned hole in the nose portion 48 so that the second connecting pin 52 may be inserted therethrough. Thus, the second connecting pin 52 is used both for connecting the first-mentioned arm 16 to the cam means 12 and to connect the ground level attachment means 102 to the cam means 12 thereby minimizing the number of parts required to adapt the instant invention for ground level sports or therapy.

The fourth connecting means includes an opening 116 through a tubular member 110 for receiving the projecting attachment portion or leg 106. A fourth connecting pin 118 is insertable through a hole in the projecting attachment portion 106 and a corresponding hole in the tubular member 110.

Referring to FIGS. 1 and 2, the assembly 10 also includes a ground simulating surface 120 which may be mounted on the mounting beams 90 in order to position the ball 20 thereover when the cam means 12 and the standard 18 are positioned so that the arm 16 is facing the platform 92. Thus, when ground level sports are being practiced, the ball 20 may be positioned on or slightly off of the ground simulating surface 120. Artificial turf 122 or the like may be laid on the ground simulating surface to simulate actual playing conditions. As will be appreciated, either the cam means 12 or the standard 18 may have a 180° out-of-phase position in order to position the ball 20 on the actual ground surface itself.

It is also noted that the self-supporting base means 76 allows the instant invention to be used outdoors as well as indoors. Although it is possible to stake or affix the standard 18 itself to the ground without the base means 76 or by directly connecting the base ring 82 to a surface or floor, it is readily appreciated that when the mounting beams 90, platform beams 94 and platform 92 are used, the base means 76 provides an assembly 10 which is completely self-contained. More specifically, the weight of a player standing on the platform 92 provides enough stability without any further supporting means even when the ball 20 is hit.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. An eye-hand coordinator assembly comprising; a standard, an arm having a support end and a ball end, a ball connected to said ball end by first connecting means, cam means connected by second connecting means to said support end of a ball-supporting arm and attached to said standard for allowing the arm and said ball to be displaceable from an initial position to various angular positions relative to the longitudinal axis of said standard in response to an impact to the ball, said cam means including an upper cam to which said arm is connected and a lower cam, said upper cam being movable for rotation and axial shifting from a rest position relative to said lower cam, biasing means positioned on the outside of said standard and interconnecting said upper cam and said lower cam for resisting said rotation and axial shifting of said upper cam relative to said lower cam and for urging said upper cam to said rest position thereby returning the arm to said initial position after an impact to the ball.

2. An assembly as set forth in claim 1 wherein said upper cam includes an upper cam surface and said lower cam includes a lower cam surface for coacting with each other to provide said rest position of said upper cam and limited axial shifting movement therefrom.

3. An assembly as set forth in claim 2 wherein said cam means includes stop means for limiting said rotation and axial shifting of said upper cam.

4. An assembly as set forth in claim 3 wherein said stop means includes a first flange on said upper cam and a second flange on said lower cam, said flanges being engageable after a predetermined amount of said rotation of said upper cam relative to said lower cam.

5. An assembly as set forth in claim 3 wherein said upper cam surface includes two sloping portions with said portions sloping downwardly from a crevice and said lower cam surface includes two sloping portions with said portions sloping downwardly from a crest, said crest being engageable with said crevice to provide said rest position of said upper cam.

6. An assembly as set forth in claim 1 including adjustment means for retaining said cam means at various vertical positions on said standard and allowing said cam means to be retained in one of two diametrically opposite 180° out-of-phase positions.

7. An assembly as set forth in claim 6 wherein said adjustment means includes a plurality of vertically spaced adjustment holes in said standard, an opening through said lower cam and an adjustment pin for extending through said opening and one of said adjustment holes.

8. An assembly as set forth in claim 7 wherein said upper cam includes a projecting stub shaft and said biasing means includes an elastic strap disposed about said projecting stub shaft and said adjustment pin.

9. An assembly as set forth in claim 1 including base means for supporting said standard and including a mounting surface and a mounting means for connecting said standard to said mounting surface, at least two mounting beams positioned in parallel relationship for supporting said mounting surface, a platform for a player to stand on and platform beams for supporting said platform, said platform beams having a telescoping relationship with said mounting beams, and positioning means for connecting said mounting beams and said platform beams at various horizontal positions relative to each other whereby the distance from said platform to the ball is adjustable.

10. An assembly as set forth in claim 11 wherein said upper cam includes an elongated nose portion, said second connection includes a tubular member having an axial opening for receiving said nose portion, said tubular member being attached to said nose portion by a pin extending transversely through an aperture in said nose portion and said tubular member, said support end of said arm extending through a transversely extending opening in said tubular member and secured therein by a pin.

11. An assembly as set forth in claim 10 wherein said arm slopes downwardly from said support end to said ball end to support said ball at substantially ground level.

* * * * *